US010500457B2

(12) United States Patent
Fuchshumer

(10) Patent No.: US 10,500,457 B2
(45) Date of Patent: Dec. 10, 2019

(54) DEVICE FOR REPAIRING PITCH MARKS

(71) Applicant: Roland Fuchshumer, Linz (AT)

(72) Inventor: Roland Fuchshumer, Linz (AT)

( * ) Notice: Subject to any disclaimer, the term of this patent is extended or adjusted under 35 U.S.C. 154(b) by 3 days.

(21) Appl. No.: 15/322,904

(22) PCT Filed: Jun. 9, 2016

(86) PCT No.: PCT/EP2016/063097
§ 371 (c)(1),
(2) Date: Dec. 29, 2016

(87) PCT Pub. No.: WO2016/198493
PCT Pub. Date: Dec. 15, 2016

(65) Prior Publication Data

US 2017/0151476 A1 Jun. 1, 2017

(30) Foreign Application Priority Data

Jun. 11, 2015 (DE) ..... 10 2015 109 336
Nov. 24, 2015 (DE) ..... 10 2015 120 311

(51) Int. Cl.
*A63B 53/00* (2015.01)
*A63B 57/50* (2015.01)
*A63B 69/36* (2006.01)

(52) U.S. Cl.
CPC ..... *A63B 57/50* (2015.10); *A63B 53/00* (2013.01); *A63B 69/3632* (2013.01); *A63B 69/3685* (2013.01); *A63B 2210/50* (2013.01)

(58) Field of Classification Search
CPC ..... A63B 53/02; A63B 53/007; A63B 53/14; A63B 57/50
USPC ..... 473/286, 298, 299
See application file for complete search history.

(56) References Cited

U.S. PATENT DOCUMENTS 3,539,017 A * 11/1970 Johnson ..... A01B 1/24 172/378
3,771,794 A * 11/1973 Crockett ..... A63B 57/50 172/378
4,925,190 A * 5/1990 Learned ..... A01B 1/24 172/378
4,955,609 A 9/1990 Kassen
5,004,240 A * 4/1991 Tsukamoto ..... A63B 47/02 294/19.2

(Continued)

OTHER PUBLICATIONS

International Search Report and Written Opinion of PCT/EP2016/063097, dated Sep. 19, 2016, 10 pgs. ( concise explanation of relevance incorporated therein).

*Primary Examiner* — Joseph B Baldori
(74) *Attorney, Agent, or Firm* — Lerner, David, Littenberg, Krumholz & Mentlik, LLP

(57) ABSTRACT

A device for repairing pitch marks, which can be attached to a golf club, may include an end section with a cylindrical body and a pitchfork, wherein the pitchfork has at least one prong and is mounted on the cylindrical body by means of fixing means, wherein the pitchfork can be fixed on the cylindrical body by means of the locking means in a retracted position and in an extended position, wherein, in the retracted position, the pitchfork rests against an outer circumferential surface of the cylindrical body, and wherein, in the extended position, the prongs project beyond the cylindrical body in an axial direction.

15 Claims, 7 Drawing Sheets

(56) References Cited

U.S. PATENT DOCUMENTS

Figure 1:
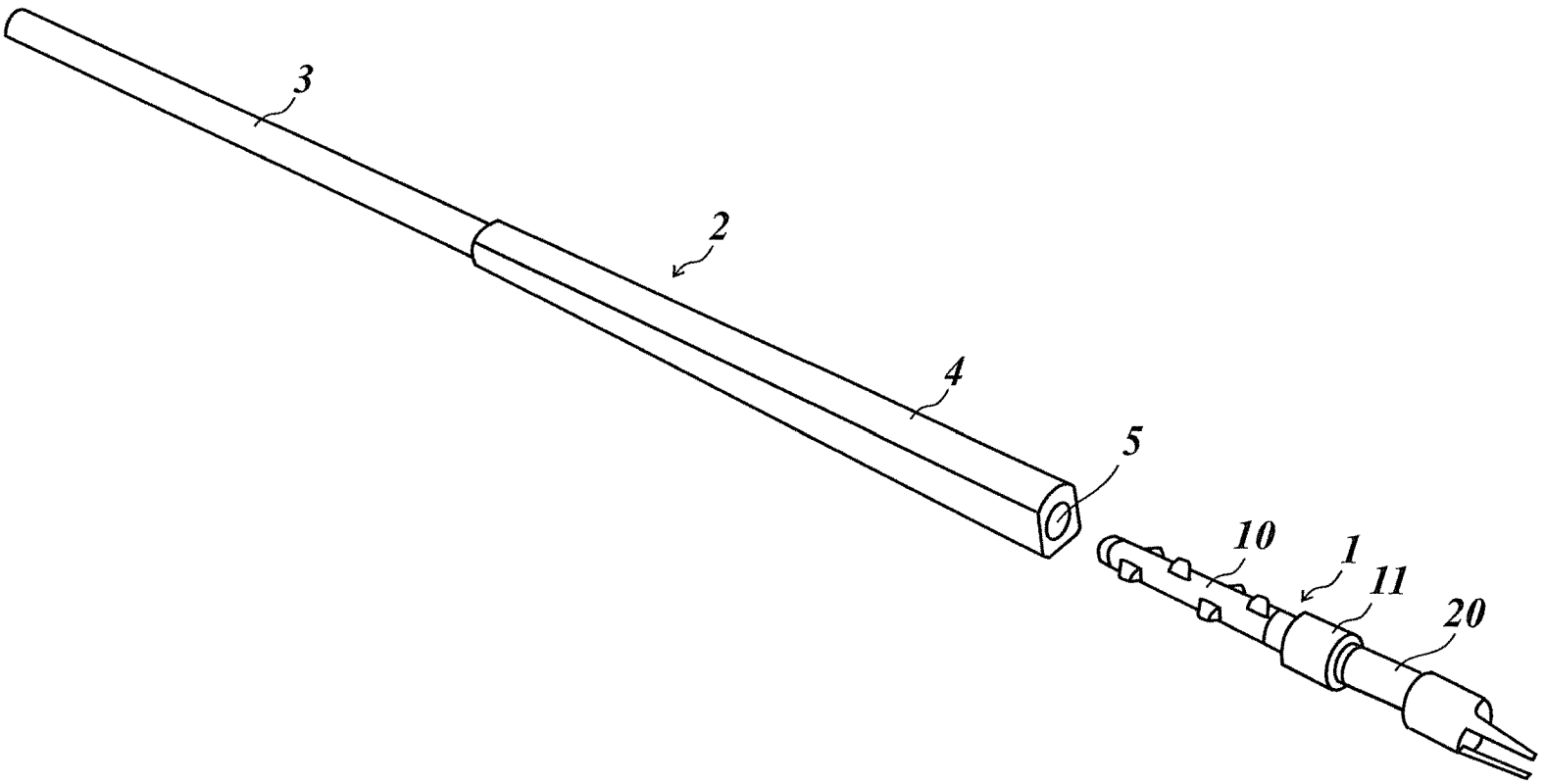

| | | | | | |
|---|---|---|---|---|---|
| 5,277,425 | A * | 1/1994 | Petriano, Sr. | A01B 1/14 | 172/381 |
| 5,377,977 | A | 1/1995 | MacNeary | | |
| 5,437,449 | A | 8/1995 | Zink | | |
| 5,511,785 | A | 4/1996 | Rusin, Jr. | | |
| 5,839,972 | A * | 11/1998 | Swanson | A63B 57/0037 | 473/286 |
| 5,899,511 | A * | 5/1999 | Dinatale | A63B 47/02 | 294/19.2 |
| 6,223,829 | B1 * | 5/2001 | Wiens | A01B 1/24 | 172/1 |
| 6,244,356 | B1 * | 6/2001 | Luna | A01B 1/24 | 172/381 |
| 6,413,174 | B1 * | 7/2002 | Roberts | A63B 57/50 | 473/408 |
| 6,743,113 | B2 * | 6/2004 | Pettinga | A63B 47/02 | 294/19.2 |
| 7,303,484 | B2 * | 12/2007 | Bieske | A63B 53/14 | 473/286 |
| 7,351,158 | B1 * | 4/2008 | Bronsveld | A63B 57/50 | 172/372 |
| 2006/0025230 | A1 * | 2/2006 | Zeuch | A63B 57/50 | 473/286 |

* cited by examiner

DEVICE FOR REPAIRING PITCH MARKS

CROSS REFERENCE TO RELATED APPLICATIONS

The present application is a national phase entry under 35 U.S.C. § 371 of International Application No. PCT/EP2016/063097 filed Jun. 9, 2016, which claims priority from German Patent Application No. 102015109339.1 filed Jun. 11, 2015 and German Patent Application No. 102015120311.1 filed Nov. 24, 2015, the disclosures of which are incorporated by reference herein.

The invention relates to a device for repairing pitch marks, which can be attached to a golf club.

By a pitch mark is meant an indentation which is caused by a golf ball striking the green, i.e. the target area of the golf course. The unevenness of the green caused by the pitch mark presents a nuisance for following golfers. According to the state of the art, in order to repair pitch marks, pitchforks are generally used, by means of which an even turf can be restored by lifting the compressed grass.

From U.S. Pat. No. 5,511,785 a device for repairing pitch marks is known which is inserted into a shaft of a golf club. In its retracted position, the known device is received completely within the shaft of the golf club. In its extended position, two prongs project axially out of an end of the shaft of the golf club opposite the club head. After turning the golf club, a golfer can repair pitch marks with the aid of the prongs. However, pulling out the prongs, which, in the retracted position, are received within the shaft of the golf club, requires much fingertip dexterity. The known device is difficult to operate, in particular when using golf gloves.

The object of the present invention is to overcome the disadvantages of the state of the art. In particular, it is intended to provide a device for repairing pitch marks which is easy to operate.

The object is achieved by the features of claim 1. Expedient embodiments of the invention result from the dependent claims.

In accordance with the invention, the device comprises an end section with a cylindrical body and a pitchfork.

In the case of the device attached to a golf club, the end section is preferably located completely outside the golf club.

Within the meaning of the present invention, by the term "cylindrical body" is also meant straight prisms, i.e. bodies with a polygon as base area and several rectangles of the same size as circumferential surface. In the axial direction, the cylindrical body preferably has a first end which is aligned with the golf club in the case of the device according to the invention attached to a golf club, and a free second end opposite the first end.

In accordance with the invention, it is furthermore provided that the pitchfork has at least one prong and is mounted on the cylindrical body by means of fixing means.

The pitchfork preferably has one to five prongs. A pitchfork with two prongs is particularly preferred. If the pitchfork only has one prong, the prong can be designed analogously to a shovel surface. The pitchfork preferably comprises furthermore a cylindrical sleeve from which the prongs extend in the axial direction. The prongs are preferably spaced apart from each other in the circumferential direction by between 1 mm and 10 mm, particularly preferably by between 4 mm and 6 mm.

In accordance with the invention, it is furthermore provided that the pitchfork can be fixed on the cylindrical body by means of the fixing means in a retracted position and in an extended position.

The pitchfork can preferably be moved between the retracted position and the extended position by means of the fixing means.

In accordance with the invention, it is furthermore provided that, in the retracted position, the pitchfork rests against an outer circumferential surface of the cylindrical body.

In the retracted position, the pitchfork preferably rests against the outer circumferential surface of the cylindrical body essentially over its entire axial extent. For example, in the retracted position, the pitchfork can rest against the outer circumferential surface of the cylindrical body over a proportion of from 75% to 100% of its axial extension. In the retracted position, the pitchfork advantageously rests against the outer circumferential surface of the cylindrical body over its entire axial extension. Particularly advantageously, the pitchfork rests against the outer circumferential surface of the cylindrical body in a positive locking manner.

In accordance with the invention, it is furthermore provided that, in the extended position, the prongs project beyond the cylindrical body in the axial direction.

Advantageously, the device is designed so that it can be attached to an essentially tubular grip which is arranged opposite a club head on a shaft of the golf club. Particularly advantageously, the device is designed so that it can be attached to a tubular shaft of the golf club which is surrounded by a grip at the end opposite the club head. To attach the device according to the invention it can be necessary to cut open or cut off a cap of the grip which is located at an end of the grip facing away from the club head. The device can then be inserted into the tubular shaft or grip in the axial direction at the end facing away from the club head. The golf club to which the device according to the invention is attached can in particular be a putter.

In the retracted position, the prongs preferably do not project beyond the free second end of the cylindrical body in the axial direction. A risk of injury arising from the pitchfork is thereby considerably reduced. Because of the arrangement of the pitchfork on the outer circumferential surface of the cylindrical body, the pitchfork is easy and convenient for a golfer to operate. The operation of the pitchfork can even take place without problems with a golf glove.

According to an advantageous embodiment of the invention, the fixing means are designed as locking means which comprise a slot in the cylindrical body and a pin on the pitchfork, wherein the pin engages in the slot.

The slot preferably extends in the axial direction along essentially the entire circumferential surface of the cylindrical body, for example along from 75% to 100% of the circumferential surface of the cylindrical body. The slot preferably has a width of from 1 to 10 mm, in particular a width of from 3 to 5 mm.

The pin can, for example, be realized by a screw which is screwed into the pitchfork in the radial direction.

According to a further advantageous embodiment of the invention, the slot comprises a first detent area, an elongate connecting section and a second detent area, wherein the elongate connecting section connects the first and second detent area with each other and preferably runs in the axial direction.

The first and/or the second detent area preferably extend in a direction perpendicular to a longitudinal axis of the cylindrical body. The first and/or the second detent area advantageously branch off in the circumferential direction from the elongate connecting section running in the axial direction. The second detent area is preferably located at one end of the elongate connecting section close to the free second end of the cylindrical body. The first detent area is preferably spaced apart axially from the second detent area in a direction facing towards the first end of the cylindrical body. The first and the second detent area can extend from the elongate connecting section in the same direction. Alternatively, they can extend from the elongate connecting section in opposite directions to each other.

The pitchfork is preferably in the retracted position when the pin engages in the first detent area. The pitchfork is preferably in the extended position when the pin engages in the second detent area.

The first and/or the second detent area can, in addition, in each case comprise an undercut. The undercut preferably extends in the axial direction without being directly connected to the elongate connecting section. The pin can thus be secured against slipping into the elongate connecting section through engagement in the undercut.

The elongate connecting section preferably has a width of from 1 to 10 mm, in particular a width of from 3 to 5 mm. The first and/or the second detent area preferably has a width of from 1 to 10 mm, in particular a width of from 3 to 5 mm. The undercut preferably has a width of from 1 to 10 mm, in particular a width of from 3 to 7 mm.

According to a further advantageous embodiment of the invention it is provided that the end section furthermore comprises a spring, and that the pitchfork can be released from the retracted position and/or from the extended position against the force of the spring.

The pin connected to the pitchfork is preferably pushed in the axial direction against an edge of the first or second detent area by the force of the spring. The pitchfork is thereby held in the retracted or extended position. The pin can be released from the first or second detent area by a sufficiently strong force in the circumferential direction. This can lead to an undesired release of the pitchfork from the retracted or extended position.

Therefore, embodiments of the invention are particularly preferred in which, to release the pitchfork from the retracted position or from the extended position, it is first to be moved in a direction opposite the spring force and then rotated laterally. Such an embodiment can be achieved, for example, by providing an undercut in each case at the first and/or second detent area.

The pitchfork is preferably always spring-loaded. Embodiments are particularly preferred in which the pitchfork automatically travels into the extended position under spring-loading after release from the retracted position.

According to a further advantageous embodiment of the invention it is provided that the cylindrical body has a cavity and that the spring is received in the cavity.

The cavity preferably extends essentially over the entire axial extension of the cylindrical body. The cavity is preferably limited at the first and/or second end of the cylindrical body by an end face connected in one piece with the cylindrical body and/or by a plug which can be attached to the cylindrical body. The end face and/or the plug can have axial apertures towards the cavity.

The slot preferably penetrates the cylindrical body as far as the cavity. The pin can thus engage into the cavity. There, the pin can be loaded by the spring either directly or via a connecting part, for example via a spring seat receiving the spring.

The spring is preferably designed as a compression spring and/or a helical spring, in particular as a helical compression spring.

According to a further advantageous embodiment of the invention it is provided that the fixing means comprise a thread, and that the pitchfork can be moved into the retracted and/or into the extended position by means of a screwing movement.

An internal thread is preferably provided on the pitchfork which engages in an external thread provided on the cylindrical body. Instead of an internal thread, a peg projecting from the inner surface of the pitchfork can be provided on the pitchfork, for example, which engages in the external thread provided on the cylindrical body. Conversely, however, an internal thread can also be provided on the pitchfork, in which a peg protruding from the outer circumferential surface of the cylindrical body engages. Embodiments of the invention with a fixing means comprising a thread have the advantage that the device can also be used to repair pitch marks with a partially extended pitchfork.

According to a further advantageous embodiment of the invention, the device furthermore comprises a clamping section and a gripping section, wherein the end section projects from the gripping section in the axial direction.

The device has an essentially cylindrical shape. In the case of the device according to the invention attached to a golf club, the end section and the gripping section preferably lie completely outside the golf club. The gripping section preferably forms an extension of the grip of the golf club. The clamping section can be inserted completely into an opening formed by the tubular shaft or grip. In the case of the device according to the invention attached to a golf club, the clamping section preferably lies completely inside the golf club.

According to a further advantageous embodiment of the invention, the clamping section is formed in one piece together with the gripping section.

The clamping section and the gripping section preferably form a base piece. The gripping section and/or the clamping section can be hollow inside. The base piece is preferably designed essentially as a hollow cylinder.

According to a further advantageous embodiment of the invention, the clamping section is provided on an insert and the gripping section is provided on a gripping piece formed separately from the insert. The insert can preferably be inserted firmly into the tubular shaft or grip of the golf club.

According to a further advantageous embodiment of the invention, the insert and the gripping piece can be connected to each other firmly by connecting means, preferably by screwing. The connecting means can enable a screw connection between the insert and the gripping piece. For this, the insert and the gripping piece can have corresponding screw threads. For example, the insert can have an insert opening and the gripping piece can have an insert pin corresponding to the insert opening. An internal thread can be provided on the insert opening and an external thread corresponding to the internal thread can be provided on the insert pin. As an alternative to the provision of a thread on both the insert and on the gripping piece, a thread can be provided on only one of the insert and the gripping piece which can interact with a peg provided on the other of the insert and gripping piece to produce a screw connection.

The connection produced by the connecting means between insert and gripping piece is preferably designed to be releasable. When several golf clubs each with an insert permanently secured thereon are provided, a device according to the invention having a gripping piece but no insert can optionally be mounted on one of these golf clubs.

The end section is preferably part of an end piece. The end piece is preferably attached to the base piece or the gripping piece. For this, the gripping section can be designed tubular. The cylindrical body can be inserted into the tubular gripping section. Therefore, in this embodiment, the cylindrical body is not completely part of the end section. Rather, in this embodiment, the cylindrical body has a first section which is part of the end section and a second section which enters into the gripping section.

Alternatively, however, the cylindrical body can also, for example, be designed in one piece together with the clamping section and/or the gripping section.

According to a further advantageous embodiment of the invention, the clamping section and/or the insert has an essentially cylindrical shape and comprises radially projecting clamping lugs by means of which the clamping section can be clamped into a golf club.

The clamping lugs are preferably designed to be spring-loaded. If the clamping section is designed hollow, the clamping lugs can be molded in each case on a spring shackle, for example. The spring shackles can bend radially inwards in the case of pressure acting radially inwards and can thus exert a restoring force acting radially outwards.

The clamping section can advantageously be inserted into the tubular shaft or grip of the golf club. The clamping lugs of a clamping section inserted into the tubular shaft or grip push from inside against the tubular shaft or grip and thereby hold the clamping section firmly in the tubular shaft or grip.

According to a further advantageous embodiment of the invention, the clamping lugs have a movement-impeding material on surfaces which project outwards in the radial direction.

By a movement-impeding material is generally meant a material which increases an adhesive force between the clamping lugs and an inner surface of the shaft or grip of the golf club. The movement-impeding material can be, for example, rubber. The clamping lugs can be formed completely from the movement-impeding material. The clamping lugs can preferably have inserts made of movement-impeding material.

According to a further advantageous embodiment of the invention, the clamping section and/or the insert has an essentially cylindrical shape at least in sections and, with an external diameter, is adapted to an internal diameter of the golf club in such a way that the clamping section and/or the insert can be fixed onto the golf club by clamping. The external diameter of the clamping section or of the insert is preferably adapted to the internal diameter of the tubular shaft or grip of the golf club.

According to a further advantageous embodiment of the invention, the clamping section and/or the insert have an adhesive on their outer surface for securing onto a golf club. The adhesive can, in particular, be a glue. With the aid of the glue, the clamping section or the insert can be glued into the tubular shaft or grip of the golf club. The adhesive can furthermore be a component of a multi-component adhesive system. In this case, the further component or the further components are to be provided for example in the tubular shaft or grip of the golf club during the gluing of the clamping section or of the insert into the tubular shaft or grip of the golf club.

The clamping section or the insert can be secured in the tubular shaft or grip of the golf club exclusively by the provision of the adhesive. Jamming between the clamping section and the tubular shaft or grip of the golf club can be completely dispensed with. Furthermore, different securing methods can also be combined. One or more adhesives, one or more clamping lugs, one or more spring shackles and/or movement-impeding material can be provided on the clamping section or on the insert. For example, the clamping section can have an adhesive in one section and, in another section, clamping lugs provided on spring shackles with a movement-impeding material on the surfaces thereof projecting outwards in the radial direction.

According to a further advantageous embodiment of the invention, the clamping section, the insert, the gripping section, the cylindrical body and/or the pitchfork are formed from plastic. The clamping section, the insert, the gripping section, the cylindrical body and/or the pitchfork can alternatively also be formed from aluminum and/or stainless steel.

For example, the base piece or insert and/or gripping piece, the cylindrical body, the pitchfork, the plug and/or a spring seat receiving the spring on one side can in each case be produced as component parts made of plastic, in particular as injection molded components. Alternatively, one or more of these component parts can be produced from aluminum and/or stainless steel.

According to a further advantageous embodiment of the invention, the device has a mass of between 20 and 40 grams. The device particularly preferably has a mass of between 25 and 30 grams.

The cylindrical body preferably has a diameter of from 7 mm to 20 mm, particularly preferably of from 11 mm to 17 mm. The gripping section preferably has a diameter of from 10 mm to 30 mm, particularly preferably of from 18 mm to 22 mm. Likewise, the sleeve of the pitchfork preferably has a diameter of from 10 mm to 30 mm, particularly preferably of from 18 mm to 22 mm. The clamping section preferably has a diameter of from 7 mm to 20 mm, particularly preferably of from 10 mm to 15 mm.

The cylindrical body preferably has an axial extension of from 4 cm to 14 cm, particularly preferably of from 6 cm to 10 cm. The prongs preferably have an axial extension of from 1 cm to 5 cm, particularly preferably of from 2.5 cm to 4 cm. The pitchfork as a whole preferably has an axial extension of from 2 cm to 10 cm, particularly preferably of from 4 cm to 7 cm. The gripping section preferably has an axial extension of from 1 cm to 5 cm, particularly preferably of from 1.5 cm to 2.5 cm. The clamping section preferably has an axial extension of from 3 cm to 15 cm, particularly preferably of from 5 cm to 12 cm, in particular 7 cm to 12 cm.

The axial distance between the pitchfork and the gripping section in the retracted position of the pitchfork is preferably between 1 mm and 10 mm, particularly preferably between 2.5 mm and 4 mm, and in the extended position of the pitchfork is between 25 mm and 50 mm, particularly preferably between 35 mm and 40 mm.

In accordance with the invention, a golf club is furthermore proposed with a removable device according to the invention.

In further accordance with the invention, an attachment is proposed for connection to an insert secured to a golf club. For repairing pitch marks, the attachment comprises an end section with a cylindrical body and a pitchfork. The pitchfork has at least one prong and is mounted on the cylindrical body by means of fixing means. The pitchfork can be fixed on the cylindrical body by means of the fixing means in a retracted position and in an extended position. In the retracted position, the pitchfork rests against an outer circumferential surface of the cylindrical body. In the extended position, the prongs project beyond the cylindrical body in the axial direction.

The end section can be designed as in the case of the device for repairing pitch marks described above.

The attachment can comprise a gripping section. The end section preferably projects from the gripping section in the axial direction.

The attachment preferably has connecting means, by means of which the attachment can be connected and/or screwed firmly to the insert secured to the golf club. The insert preferably has connecting means corresponding thereto.

The invention is now explained in more detail with reference to embodiment examples. There are shown in FIG. 1 a perspective view of a device according to the invention close to a partially represented golf club, FIG. 2 a perspective exploded view of the device according to the invention, FIG. 3 a perspective view of the device according to the invention in the retracted position, FIG. 4 a perspective view of the device according to the invention in the extended position, FIG. 5 a perspective view of a further device according to the invention close to a partially represented golf club, FIG. 6 a perspective exploded view of the further device according to the invention, FIG. 7 a longitudinal section through an insert of the further device according to the invention, and FIG. 8 a longitudinal section through a gripping piece of the further device according to the invention.

FIG. 1 shows a device 1 according to the invention directly before insertion into a partially represented golf club 2. The golf club 2 can in particular be a putter. The golf club 2 comprises a tubular shaft 3 and a grip 4 surrounding the shaft 3 in an outer section. A club head provided at an end of the shaft 3 opposite the grip 4 is not represented. The golf club 2 has an axially running opening 5 which is surrounded by the shaft 3 and the grip 4. If the grip 4 has a cap which covers the opening 5, in a step prior to the insertion of the device 1, the cap of the grip 4 is first of all to be cut off or cut open with the result that the opening 5 is exposed.

The device 1 has a clamping section 10, a gripping section 11 and an end section 20. For attaching the device 1 to the golf club 2, the device 1 is to be gripped on the gripping section 11 and inserted into the opening 5 with the clamping section 10 in front. The insertion is preferably to be continued until the clamping section 10 is received completely inside the opening 5 and the gripping section 11 rests flush against the grip 4 of the golf club 2. The device 1 is then secured firmly on the golf club 2. The gripping section 11 and the end section 20 lie completely outside the golf club 2. The device 1 can now be used to repair pitch marks with the golf club 2 as handle.

On replacing an old golf club equipped with the device 1 with a new golf club, it is necessary to remove the device from the old golf club. The device 1 can be removed from the old golf club by pulling strongly on the gripping section 11, optionally with the aid of pliers, without damaging the device 1 or the old golf club. The device can then be inserted into the new golf club as described above.

Figure 2:
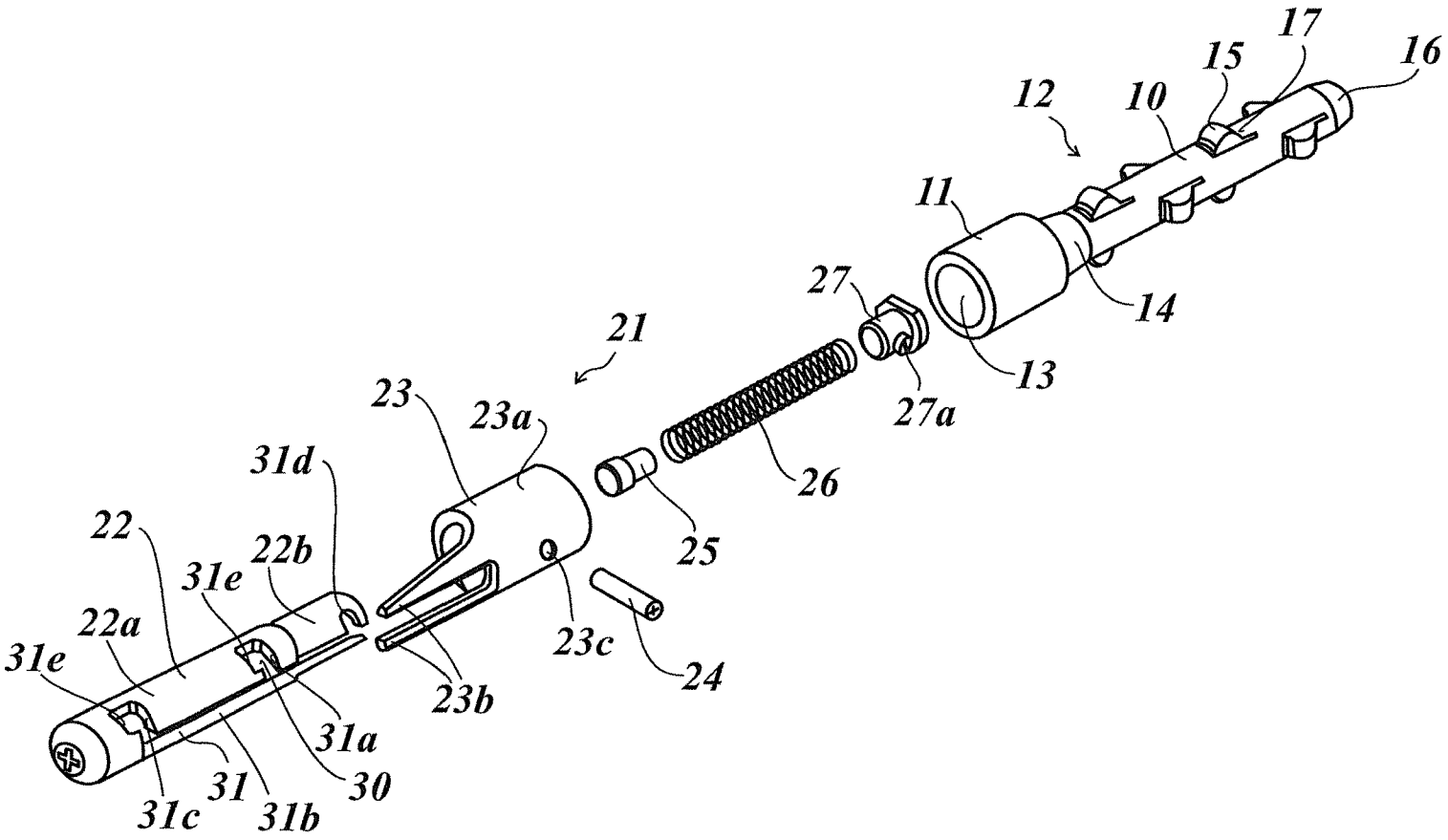

FIG. 2 shows component parts from which the device 1 is constructed. The clamping section 10 and the gripping section 11 together form a base piece 12. The base piece 12 is essentially a hollow cylinder with an axially penetrating recess 13. The gripping section 11 is formed completely as a hollow cylinder and has a larger external diameter than the clamping section 10. The recess 13 also has a larger diameter in the area of the gripping section 11 than in the area of the clamping section 10. In the clamping section 10, the cylindrical shape is broken by a conical transition area 14, clamping lugs 15 and a conically tapering mouth area 16. In the transition area 14, the external diameter increases towards the gripping section 11 without reaching the external diameter of the gripping section 11. In the transition area 14, the recess 13 has a diameter increasing towards the gripping section 11 and a smooth transition between clamping section 10 and gripping section 11.

The clamping lugs 15 project radially outwards from the clamping section 10. The clamping lugs have in each case a steeper side axially in the direction of the gripping section 11 than in the opposite direction. The clamping lugs 15 are molded onto spring shackles 17. The spring shackles 17 extend in the direction of the gripping section 11. The clamping lugs 15 and the spring shackles 17 are formed in one piece with the base piece 12. The base piece 12 has U-shaped incisions 17 which surround the spring shackles 17.

The further component parts represented in FIG. 2 form an end piece 21 comprising the end section 20. The end piece 21 is composed of a cylindrical body 22, a pitchfork 23, a pin 24, a spring seat 25, a spring 26 and a plug 27.

The cylindrical body 22 comprises a first section 22*a* and a second section 22*b*. The first section 22*a* is part of the end section 22 and has a larger external diameter than the second section 22*b*. The external diameter of the second section 22*b* corresponds to the diameter of the recess 13 in the gripping section 11, with the result that the cylindrical body 22 can be inserted into the recess 13 of the gripping section 11 of the base piece 12 with the second section 22*b*.

The cylindrical body 22 has an axially extending cavity 30 which completely penetrates the second section 22*b*. The cylindrical body 22 is therefore opened towards the outside in the axial direction on the second section 22*b*. Furthermore, the cylindrical body 22 has a slot 31 which penetrates the cylindrical body 22 in the radial direction as far as the cavity 30. The slot 31 comprises a first detent area 31*a*, an elongate connecting section 31*b*, a second detent area 31*c* and a notch 31*d*. The first detent area 31*a* is closer to the second section 22*b* than the second detent area 31*c*. The elongate connecting section 31*b* runs in the axial direction and connects the first 31*a* and second detent area 31*c* with each other. The first 31*a* and second detent area 31*c* moreover have in each case an undercut 31*e* extending axially in a direction facing away from the second section. In addition, the elongate connecting section 31*b* communicates with the notch 31*d* to receive a peg 27*a* provided on the plug 27.

The pitchfork 23 has a sleeve 23*a* designed as a hollow cylinder and two prongs 23*b* extending from the sleeve 23*a* in the axial direction. Both the surfaces of the prongs 23*b* lying radially outwards and those lying radially inwards have in each case the same cylindrical curvature as the corresponding surfaces of the sleeve 23*a*. The prongs 23*b* are therefore designed as if they had been cut out of a hollow cylinder continuing the sleeve 23*a*. An internal diameter of the sleeve 23*a* corresponds to the external diameter of the first section 22*a*, with the result that the sleeve 23*a* can be brought to rest in a positive-locking manner against the first section 22*a*. Correspondingly, the prongs 23*b* can at the same time be brought to rest in a positive-locking manner against the first section 22*a*. The sleeve has a radial hole 23*c* into which the pin 24 can be inserted. The pin 24 can be designed at least partially as a screw in order to enable it to be screwed into the hole 23*c*.

In the following, the function of the different parts of the device 1 are explained:

By inserting the clamping section 10 into the opening 5 of the shaft 3 of the golf club 2, the clamping lugs 15 are pushed from inside against the tubular shaft 3. The clamping lugs 15 are thereby deflected radially inwards together with the spring shackles 17. The deflection of the spring shackles 17 causes a spring force acting radially outwards, which is exerted by the clamping lugs 15 on the shaft 3 from the inside. The clamping section 10 is held firmly in the shaft 3 by this force. Moreover, pulling the clamping section 10 out of the shaft 3 axially requires a greater force than insertion into the shaft 3 because of the sides running more steeply axially in the direction of the gripping section 11 than in the opposite direction according to the principle of a barb.

In the case of the device 1 attached to a golf club 2, the transition area 14 forms a stopper blocking the opening 5 of the shaft 3 of the golf club 2. A good fit of the device 1 on the golf club 2 is thereby achieved and dirt is prevented from entering the opening 5 of the shaft 3. Moreover, the conical profile of the transition area 14 leads to a smoother transition between clamping section 10 and gripping section 11. The stability of the base piece 12 is thus increased by the conical profile of the transition area 14. The conically tapering mouth area 16 facilitates the insertion of the clamping section 10 into the shaft 3.

The different parts of the end piece 21 interact as follows:

The pin 24 is designed in such a way that it engages radially in the slot 31 and the cavity 30. The pitchfork can be mounted on the cylindrical body 22 by the pin 24, the slot 31 and the plug 27 in such a way that the pitchfork can only assume positions with respect to the cylindrical body 22 predetermined by the slot.

The cavity 30 is designed together with the spring seat 25 to receive the spring 26. The spring 26 is received in the spring seat 25 at its end facing away from the second section 22*b*. The spring seat 25 rests against the pin 24 with its side facing away from the spring 26. By inserting the plug 27 into the second section 22*b*, the spring 26 and spring seat 25 are secured against slipping out of the cavity 30. Moreover, the spring 26 is compressed by the plug 27. The spring 26 thereby exerts a force on the pin 24 which acts axially in a direction facing away from the second section 22*b*. The pitchfork 23 connected to the pin 24 is pushed away from the second section 22*b* by this force, i.e. pushed in the direction of the extended position.

For the insertion of the plug 27, this is first of all inserted into the cavity 30 on the second section 22*b* in the axial direction. The peg 27*a* engages in the elongate connecting section 31*b*. By a rotation in the circumferential direction, the peg 27*a* is then brought into engagement with the notch 31*d*. An axial movement of the plug 27 is thereby blocked.

Figure 3:
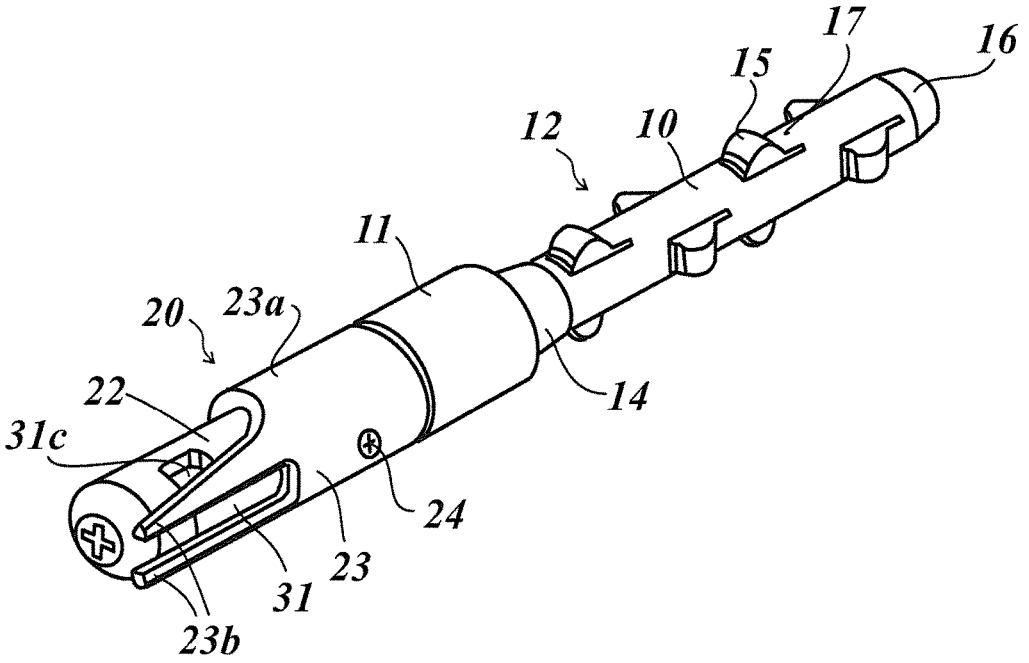
Figure 4:
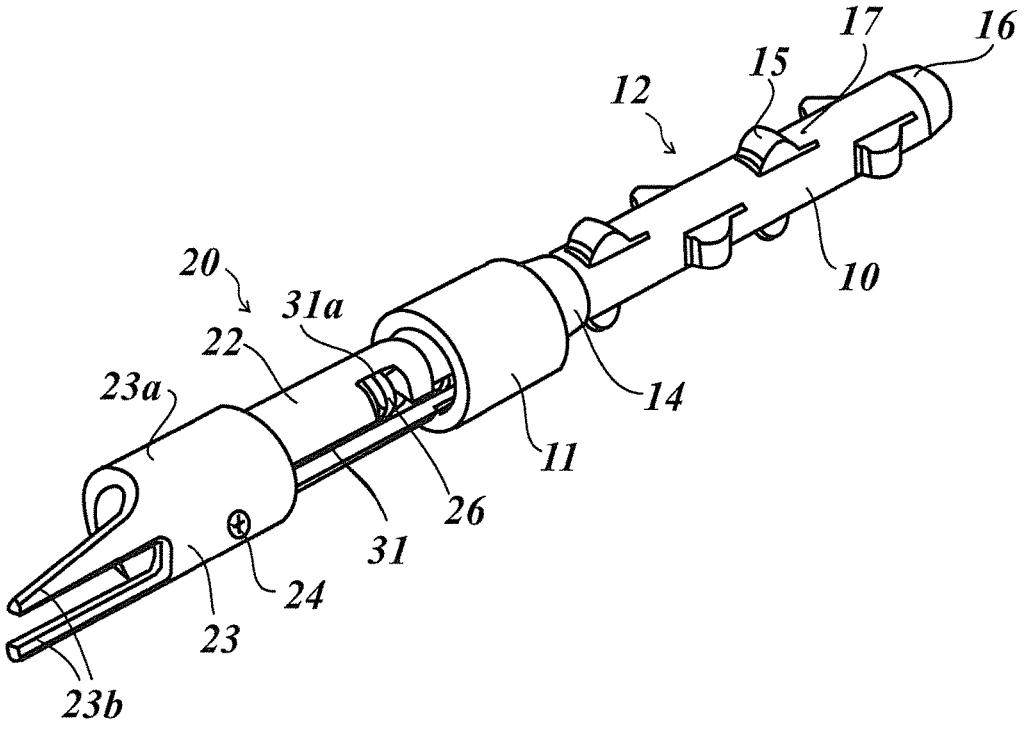

FIG. 3 and FIG. 4 show the device 1 in the assembled form. To connect end piece 21 and base piece 12, the second section 22*b* of the cylindrical body 22 is inserted into the recess 13 of the gripping section 11. The second section 22*b* of the cylindrical body 22 is designed in such a way that it only engages in the recess 13 in the area of the gripping section 11.

FIG. 3 shows the device 1 with retracted pitchfork 23. However, here the pin 24 is not received in the first detent area 31*a*. Instead, the pin 24 engages in the elongate connecting section 31 b directly next to the first detent area 31*a*. In this position, it is necessary for the pitchfork 23 to be held fast for example by a golfer's hand. Otherwise, pin 24 and pitchfork 23 would be pushed out of this position along the elongate connecting section 31*b* in the direction of the extended position by the spring force of the spring 26. By turning the pitchfork 23 in the circumferential direction out of the position represented in FIG. 3, with the result that the pin 24 engages in the first detent area 31*a*, the pitchfork 23 can be locked in the retracted position.

In the retracted position, both the sleeve 23*a* and the two prongs 23*b* of the pitchfork 23 rest against an outer circumferential surface of the cylindrical body 22 in the first section 22*a*.

FIG. 4 shows the device 1 with extended pitchfork 23. Here, the pin 24 is not received in the second detent area 31*c*. Instead, the pin 24 engages in the elongate connecting section 31 b directly next to the second detent area 31*c*. In this position, pin 24 and pitchfork 23 are automatically pushed by the spring force of the spring 26 when the pitchfork 23 is released by the golfer, while the pin 24 is located at any desired position within the elongate connecting section 31*b*. By turning the pitchfork 23 in the circumferential direction out of the position represented in FIG. 4, with the result that the pin 24 engages in the second detent area 31*c*, the pitchfork 23 can be locked in the extended position.

In the extended position, the sleeve 23*a* also rests against the outer circumferential surface of the cylindrical body 22 in the first section 22*a*. The prongs 23*b* project axially from the cylindrical body 22 in a direction facing away from the second section 22*b*.

The undercuts 31*e* represented in FIG. 2, but not in FIG. 3 and FIG. 4, can receive the pin 24 in such a way that the latter cannot be returned to the elongate connecting section 31*b* simply by turning in the circumferential direction. To release the pin 24 from the undercut 31*e*, first of all an axial movement of the pin 24 in the direction of the second section 22*b* against the spring force of the spring 26 is required. The pin 24 can only be returned to the elongate connecting section 31*b* by turning in the circumferential direction immediately after this movement. The undercuts 31 e therefore additionally secure the pitchfork 23 in the retracted and the extended position and prevent it from being released from these positions unintentionally.

With the pitchfork 23 locked in the extended position, a golfer can comfortably remedy pitch marks by means of the golf club 2. As the prongs 23*b* rest against the cylindrical body 22, there is no danger of injury to the golfer when the pitchfork 23 is retracted.

Figure 5:
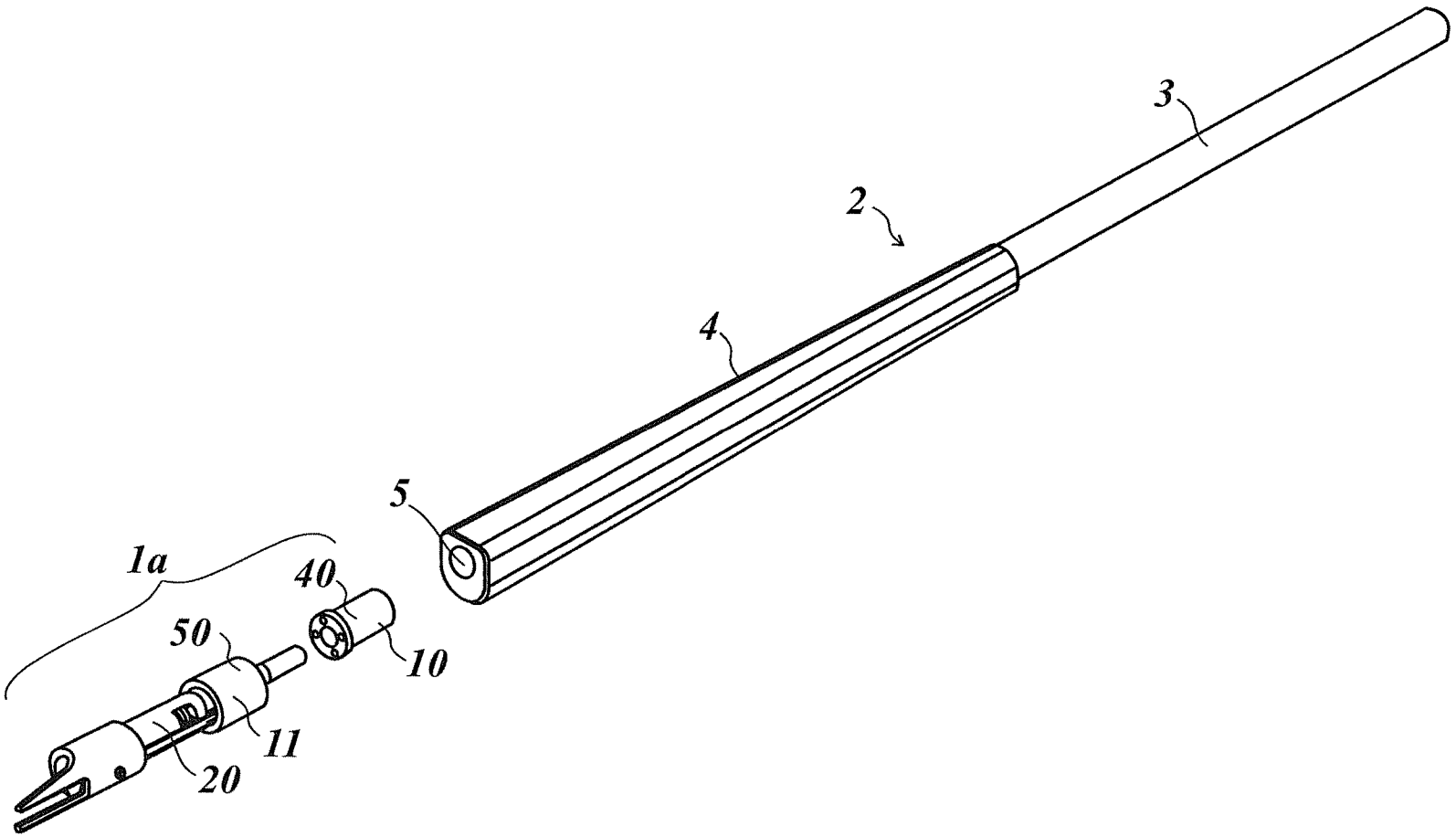

FIG. 5 shows a further device 1*a* according to the invention immediately before insertion into a partially represented golf club 2. The golf club 2 corresponds to the golf club 2 already explained in FIG. 1 and can in particular be a putter. The golf club 2 again comprises a tubular shaft 3 and a grip 4 surrounding the shaft 3 in an outer section. The club head provided at the end of the shaft 3 opposite the grip 4 is again not represented. Corresponding to FIG. 1, the golf club 2 has an axially running opening 5 which is surrounded by the shaft 3 and the grip 4. If the grip 4 has a cap which covers the opening 5, again the cap of the grip 4 is first of all to be cut off or cut open with the result that the opening 5 is exposed.

The further device 1*a* is an assembly of an insert 40 to be inserted into the opening 5 and an attachment to be attached to the insert 40. The insert 40 comprises the clamping section 10. The attachment comprises the gripping section 11 and the end section 20. In the further device 1*a*, the clamping section 10 and the gripping section 11 are therefore not formed in one piece. The insert 40 can be permanently received in the opening 5 of the grip 4 of the golf club 2, for example by gluing. The insert 40 is preferably inserted into the opening 5 in such a way that the clamping section 10 is completely received inside the opening 5. A flange section 43 provided on the insert 40 and represented more accurately in FIG. 7 then lies flush against the grip 4 of the golf club 2. The attachment can be connected firmly to the insert 40 for example by means of a screw connection. The further device 1*a* is thus secured firmly to the golf club 2. The gripping section 11 and the end section 20 lie completely outside the golf club 2. The further device 1*a* can thus also be used to repair pitch marks with the golf club 2 as handle.

The screw connection between the insert 40 and the attachment is preferably designed to be releasable. The provision of the separate insert 40 thus makes it possible to operate several golf clubs 2 with the same pitchfork. For this, every golf club 2 is to be provided with its own insert 40. The attachment comprising the pitchfork can then simply be unscrewed from one of the golf clubs 2 and screwed onto another of the golf clubs 2.

Figure 6:
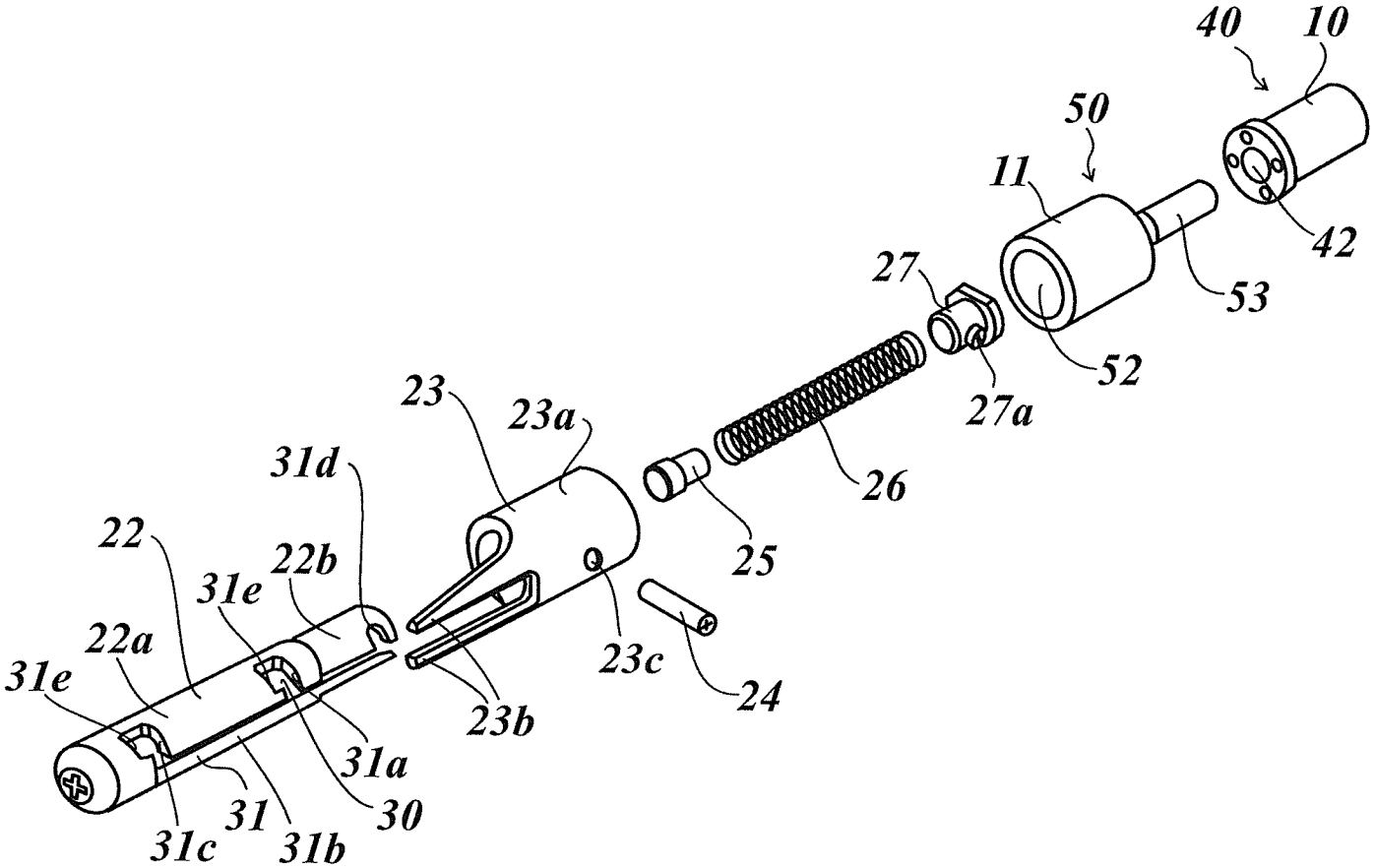

FIG. 6 shows the component parts from which the further device 1*a* is constructed. In contrast to the device 1 represented in FIGS. 1 to 4, the clamping section 10 and the gripping section 11 are formed by two different components. The insert 40 comprises the clamping section 10. A gripping piece 50 formed separately therefrom comprises the gripping section 11. The insert 40 and the gripping piece 50 are designed in each case essentially rotationally symmetrical. The insert 40 is designed as a hollow cylinder and has an insert opening 42. The gripping piece 50 has an insert pin 53 corresponding thereto. By engaging the insert pin 53 in the insert opening 42, the insert 40 and the gripping piece 50 can be firmly connected to each other. For this, the insert opening 42 preferably has an internal thread 44 and the insert pin 53 has an external thread 54 corresponding thereto. The gripping piece 50 furthermore has a further recess 52 at its end face opposite the insert pin 53. Like the recess 13 provided in the device 1, the further recess 52 is designed to receive the second section 22*b* of the cylindrical body 22.

The arrangement, the design and the function of the remaining parts (plug 27, spring 26, spring seat 25, pitchfork 23, pin 24 and cylindrical body 22) provided in the further device 1*a* correspond to the arrangement, the design and the function of these parts in the device 1. Reference is made to the above statements regarding device 1.

The attachment comprises the gripping piece 50, the plug 27, the spring 26, the spring seat 25, the pitchfork 23, the pin 24 and the cylindrical body 22 (see FIG. 5 and FIG. 6).

Figure 7:
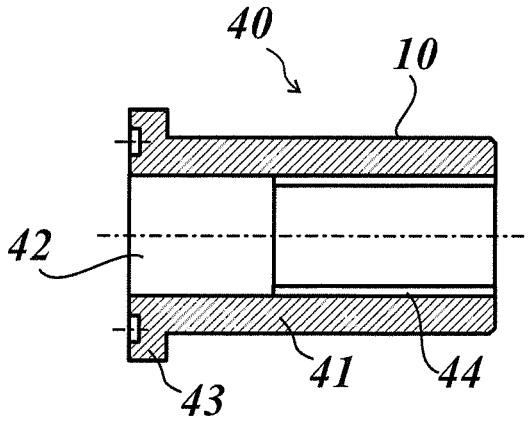

FIG. 7 shows a longitudinal section through the insert 40 of the further device 1*a*. The insert 40 is formed essentially rotationally symmetrical about an axis of rotation extending in the longitudinal direction. The insert 40 comprises a tubular section 41 which a flange section 43 adjoins on one side. The tubular section 41 forms the clamping section 10. The insert 40 can be permanently received in the opening 5 of the grip 4 of a golf club 2 by applying an adhesive, e.g. a glue, to an outer surface of the tubular section 41. Alternatively or in addition, the insert 40 can be firmly received in the opening 5 of the grip 4 of the golf club 2 by clamping. For this, the tubular section 41 can be designed corresponding to the clamping section 10 of the device 1 and have clamping lugs 15 and/or spring shackles 17.

An internal thread 44 is provided on an inner surface of the tubular section 41. The internal thread 44 can extend essentially along the entire longitudinal extension or along a part of the longitudinal extension of the tubular section 41.

The internal thread 44 is provided to interact with an external thread 54 provided on the gripping piece 50. Instead of the internal thread 44, it is possible to merely provide a peg on the inner surface of the tubular section 41. The tubular section 41 and the flange section 43 surround the cylindrical insert opening 42. The cylindrical insert opening 42 is provided to receive the insert pin 53.

Figure 8:
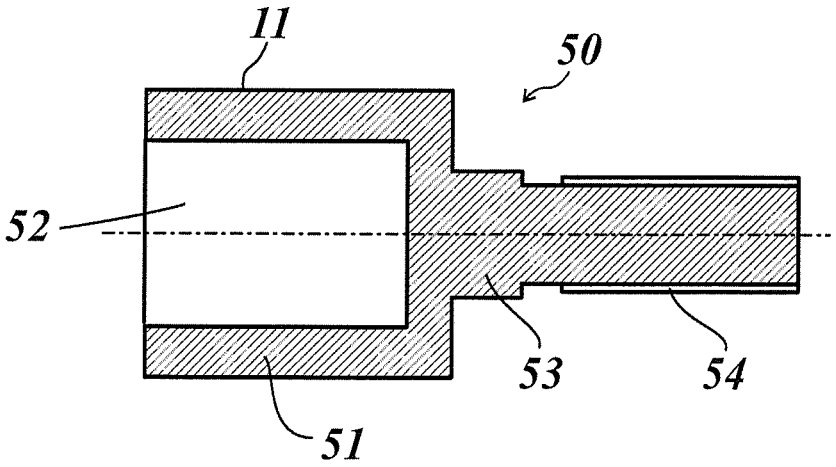

FIG. 8 shows a longitudinal section through the gripping piece 50 of the further device 1*a*. The gripping piece 50 is formed essentially rotationally symmetrical about an axis of rotation extending in the longitudinal direction. The gripping piece 50 comprises an annular section 51 and the insert pin 53. The insert pin 53 is designed essentially cylindrical and comprises the external thread 54. The external thread 54 can extend essentially along the entire longitudinal extension or along a part of the longitudinal extension of the insert pin 53. The external thread 54 is provided to interact with the internal thread 44 provided in the insert 40. Instead of the external thread 54, it is possible to merely provide a peg on the outer surface of the insert pin 53. The annular section 51 forms the gripping section 11. The annular section 51 surrounds the further recess 52. The further recess 52 is provided to receive the second section 22*b* of the cylindrical body 22.

LIST OF REFERENCE NUMBERS

1 device
1*a* further device
2 golf club
3 shaft
4 grip
5 opening
10 clamping section
11 gripping section
12 base piece
13 recess
14 transition area
15 clamping lugs
16 mouth area
17 spring shackles
20 end section
21 end piece
22 cylindrical body
22*a* first section
22*b* second section
23 pitchfork
23*a* sleeve
23*b* prongs
23*c* hole
24 pin
25 spring seat
26 spring
27 plug
27*a* peg
30 cavity
31 slot
31*a* first detent area
31*b* elongate connecting section 31*b*
31*c* second detent area
31*d* notch
31*e* undercut
40 insert
41 tubular section
42 insert opening
43 flange section
44 internal thread

50 gripping piece
51 annular section
52 further recess
53 insert pin
54 external thread

The invention claimed is:

1. A device for repairing pitch marks, which can be attached to a golf club, the device comprising:

an end section with a cylindrical body, a spring and a pitchfork;

a gripping section, wherein the end section projects from the gripping section in an axial direction, wherein the pitchfork has at least one prong and is mounted on the cylindrical body by means of a slot in the cylindrical body and a pin in the pitchfork such that the pitchfork is movable axially over an outer circumferential surface of the cylindrical body and the pin is not fixed in a single position relative to the golf club, wherein the pitchfork can be fixed on the cylindrical body by means of the slot and pin in a retracted position and in an extended position, wherein, in the retracted position, the pitchfork rests against the outer circumferential surface of the cylindrical body and the spring is in a compressed state within the cylindrical body, and wherein, in the extended position, the at least one prong projects beyond the cylindrical body in the axial direction and the spring is in an elongated state within the cylindrical body; and a clamping section, wherein the clamping section can be inserted into a tubular shaft or grip of the golf club, wherein the clamping section projects from the gripping section in a direction opposite to the axial direction, wherein at least one of the clamping section or an insert on which the clamping section is provided has an essentially cylindrical shape at least in sections and comprises radially projecting clamping lugs, by means of which the clamping section can be clamped into the golf club, and wherein each of the clamping lugs has a steeper side in the axial direction than in the opposite direction.

2. The device according to claim 1, wherein the slot comprises a first detent area, an elongate connecting section and a second detent area, wherein the elongate connecting section connects the first and second detent area with each other.

3. The device according to claim 2, wherein the elongate connecting section runs in the axial direction.

4. The device according to claim 1, wherein the pitchfork can be released from at least one of (i) the retracted position by a force of the spring or (ii) the extended position against the force of the spring.

5. The device according to claim 4, wherein the cylindrical body has a cavity and the spring is received in the cavity.

6. The device according to claim 1, wherein the clamping section is formed in one piece together with the gripping section.

7. The device according to claim 1, wherein the clamping section is provided on an insert and the gripping section is provided on a gripping piece formed separately from the insert, and wherein the insert can be inserted firmly into a tubular shaft or grip of the golf club.

8. The device according to claim 7, wherein the insert and the gripping piece can be connected to each other firmly by connecting means.

9. The device according to claim 8, wherein the insert and the gripping piece can be connected to each other firmly by screwing.

10. The device according to claim 1, wherein the clamping lugs have a movement-impeding material on surfaces which project outwards in a radial direction.

11. The device according to claim 1, wherein at least one of the clamping section or an insert on which the clamping section is provided has an adhesive on its outer surface for securing onto the golf club.

12. The device according to claim 1, wherein at least one of the clamping section, an insert on which the clamping section is provided, the gripping section, the cylindrical body or the pitchfork is formed from plastic.

13. The device according to claim 1, wherein the device has a mass of between 20 and 40 grams.

14. The device according to claim 1, wherein the clamping lugs are molded onto spring shackles.

15. The device according to claim 14, wherein the spring shackles extend in the axial direction.

* * * * *